US008215232B2

(12) United States Patent
Lee et al.

(10) Patent No.: US 8,215,232 B2
(45) Date of Patent: Jul. 10, 2012

(54) COOKING APPARATUS AND CLEANING METHOD FOR THE SAME

(75) Inventors: Seong Bin Lee, Seoul (KR); Jeong Ho Lee, Seoul (KR); Kyu In Shim, Seoul (KR)

(73) Assignee: LG Electronics Inc., Seoul (KR)

( * ) Notice: Subject to any disclaimer, the term of this patent is extended or adjusted under 35 U.S.C. 154(b) by 568 days.

(21) Appl. No.: 12/441,650

(22) PCT Filed: Oct. 8, 2007

(86) PCT No.: PCT/KR2007/004893

§ 371 (c)(1),
(2), (4) Date: Mar. 17, 2009

(87) PCT Pub. No.: WO2008/044844

PCT Pub. Date: Apr. 17, 2008

(65) Prior Publication Data

US 2009/0266243 A1 Oct. 29, 2009

(30) Foreign Application Priority Data

Oct. 10, 2006 (KR) ..... 10-2006-0098240

(51) Int. Cl.
*A47J 31/00* (2006.01)

(52) U.S. Cl. ..... 99/536; 99/516; 99/467; 99/476

(58) Field of Classification Search ..... 99/516, 99/536, 467, 473, 476; 219/400, 401, 402; 126/20, 198, 237 R, 273 R; 428/226, 228, 428/426, 428

See application file for complete search history.

(56) References Cited

U.S. PATENT DOCUMENTS

| | | | | | |
|---|---|---|---|---|---|
| 3,617,366 | A * | 11/1971 | Tully et al. | ..... | 428/206 |
| 3,979,575 | A * | 9/1976 | Maahs | ..... | 219/407 |
| 5,786,577 | A * | 7/1998 | Han et al. | ..... | 219/682 |
| 6,613,860 | B1 | 9/2003 | Dams et al. | | |
| 6,896,934 | B2 | 5/2005 | Aronica et al. | | |
| 6,909,071 | B2 * | 6/2005 | Shozo | ..... | 219/401 |
| 7,037,591 | B2 * | 5/2006 | Henze et al. | ..... | 428/447 |

FOREIGN PATENT DOCUMENTS

| | | | |
|---|---|---|---|
| EP | 1 147 731 | A1 | 10/2001 |
| EP | 1 391 249 | A1 | 2/2004 |
| EP | 1 517 092 | A1 | 3/2005 |
| JP | 10-185197 | * | 7/1998 |
| JP | 2006-84086 | A | 3/2006 |
| WO | WO-99/02463 | A1 | 1/1999 |
| WO | WO-2004/088208 | A1 | 10/2004 |

* cited by examiner

*Primary Examiner* — Reginald L Alexander

(74) *Attorney, Agent, or Firm* — Birch, Stewart, Kolasch & Birch, LLP

(57) ABSTRACT

A cooking apparatus for assuring easier cleaning of contaminants, such as food residue, attached to the wall surface of a cavity in the cooking apparatus is disclosed. The cooking apparatus includes a body defining the outer appearance of the cooking apparatus, and a cavity defining a space for heating and cooking an object and having an inner surface to form an oil-repellent surface by being heated. In a cleaning method for the cooking apparatus, the inner surface of the cavity is heated prior to cooking food, to have an oil-repellency. The inner surface makes it difficult for the contaminants to be attached thereto. Even if the contaminants are attached, the contaminants have a very low adhesive power and thus are easy to clean.

8 Claims, 6 Drawing Sheets

[Fig. 1]
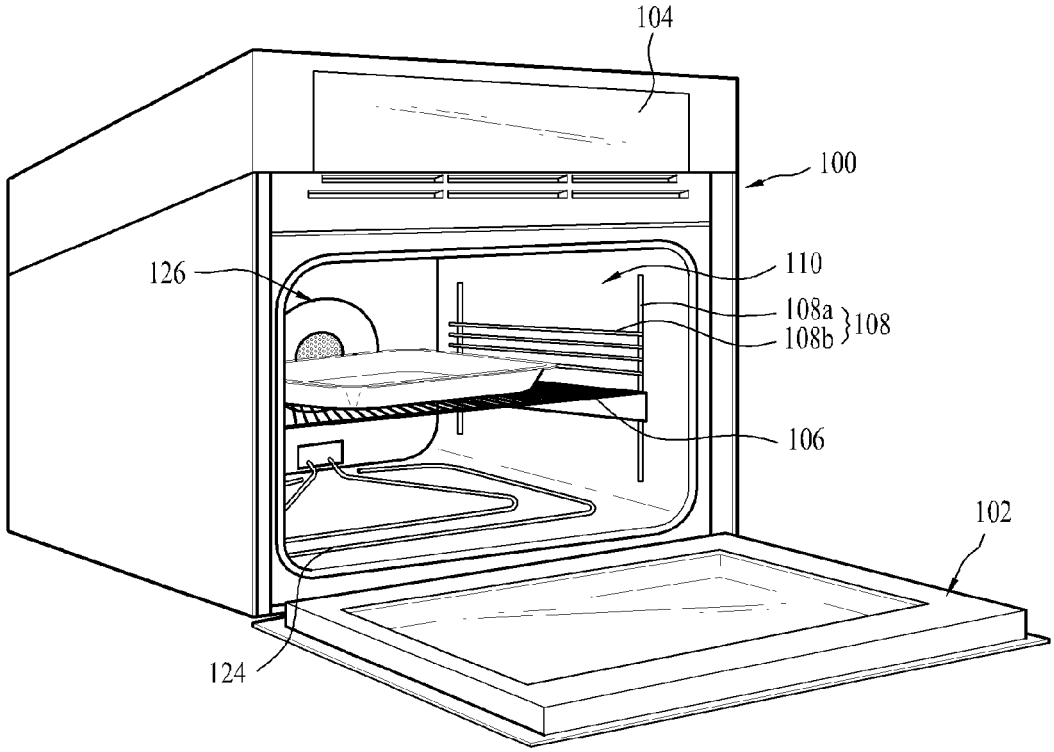

[Fig. 2]
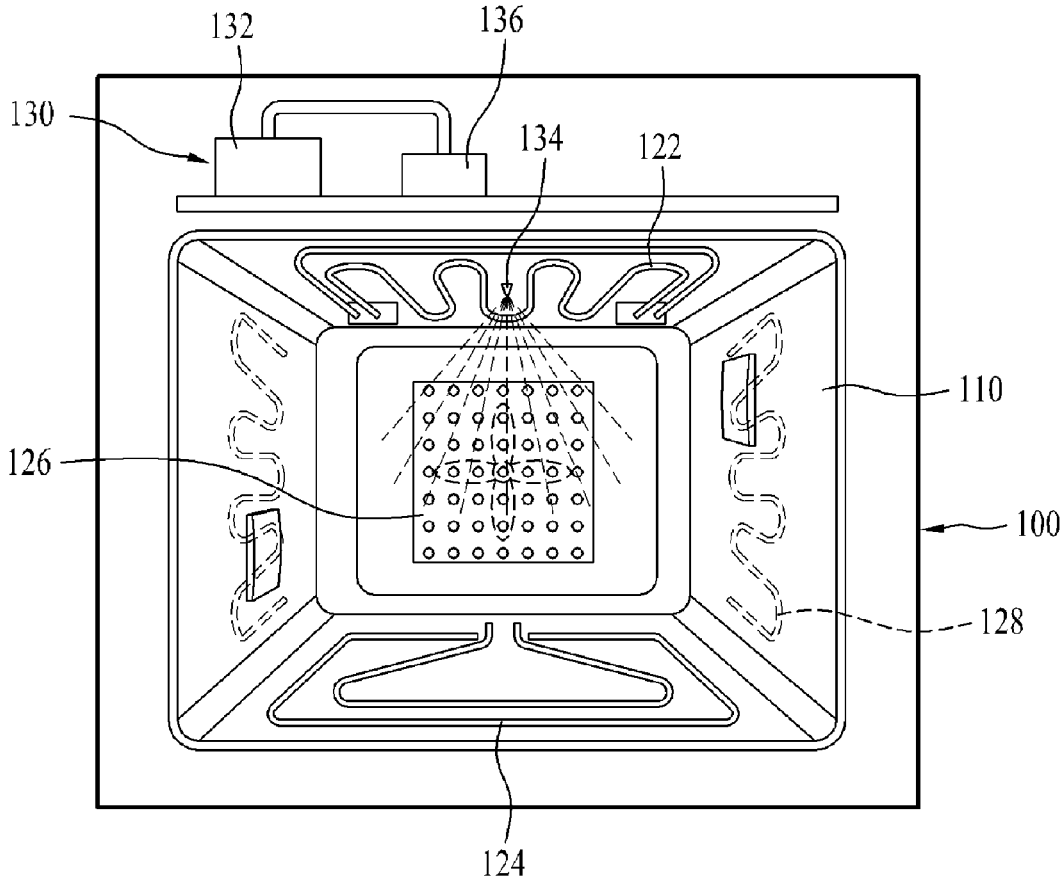
[Fig. 3]
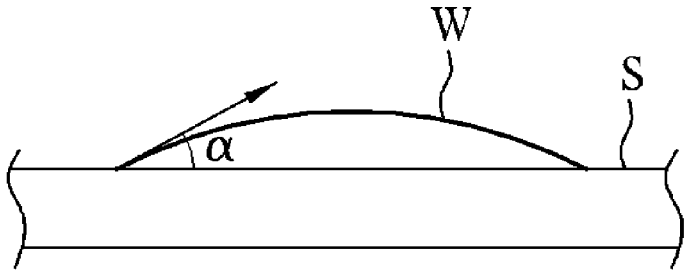

[Fig. 4]
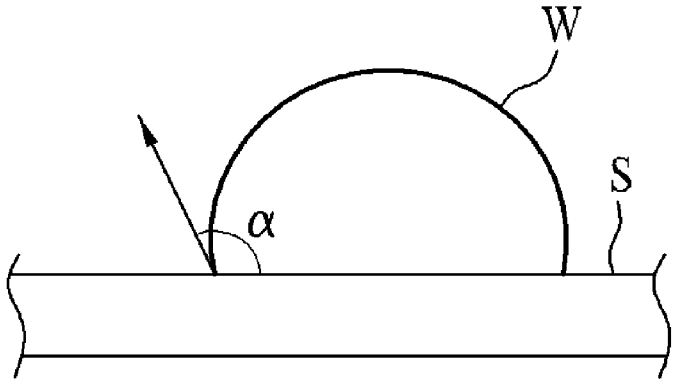
[Fig. 5]
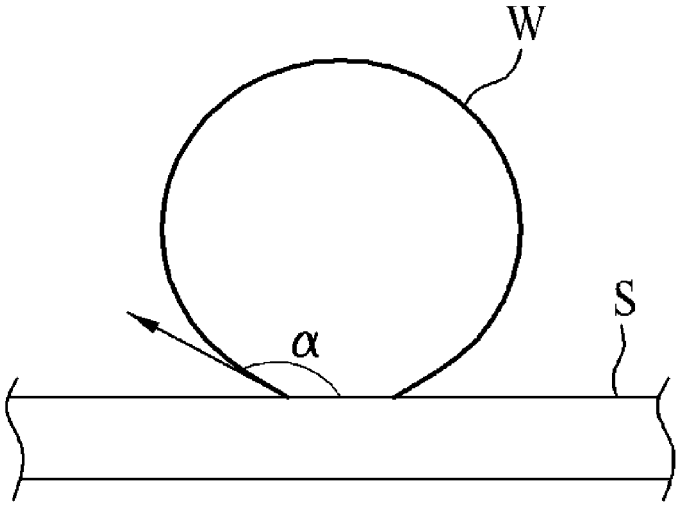
[Fig. 6]
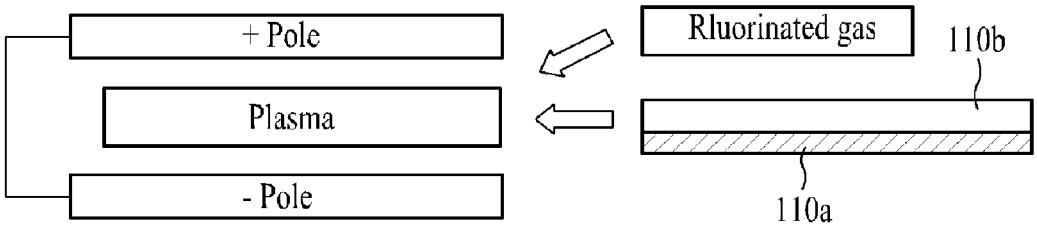

[Fig. 7]
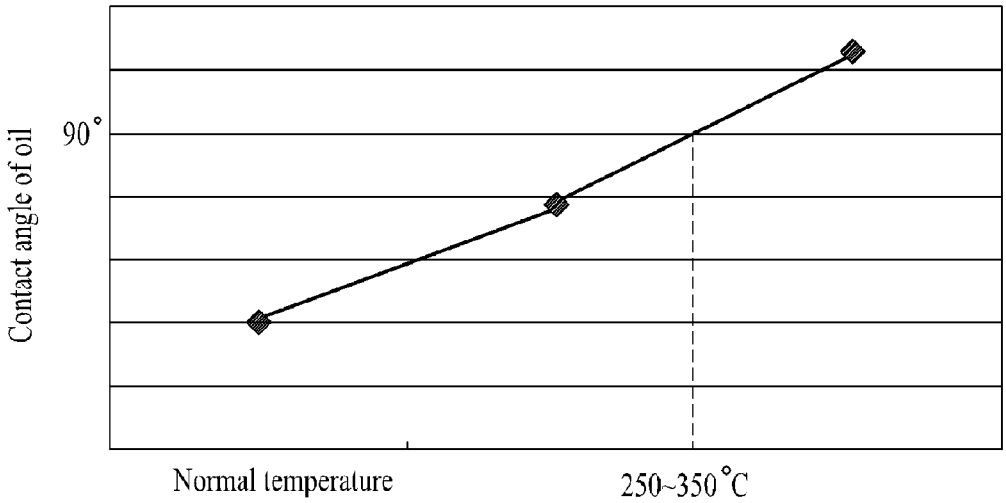
[Fig. 8]
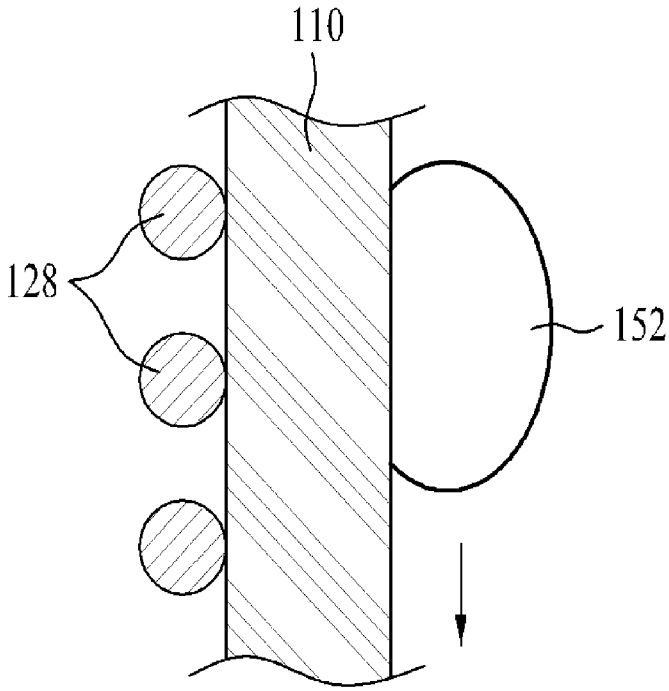

[Fig. 9]
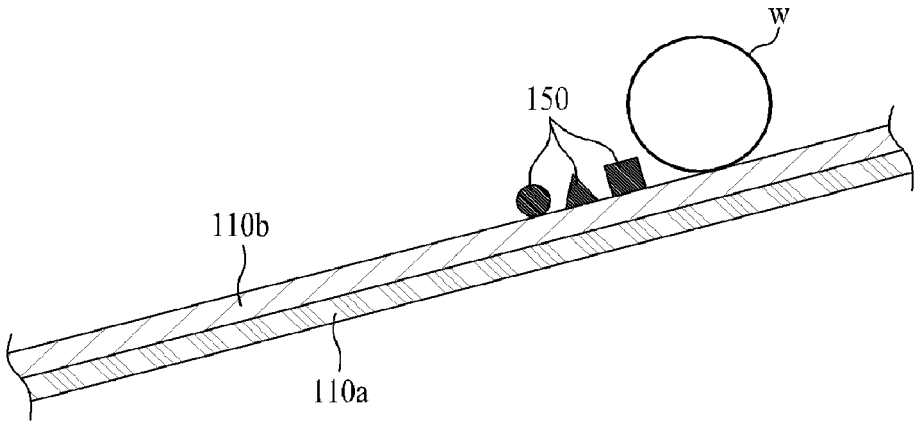
[Fig. 10]
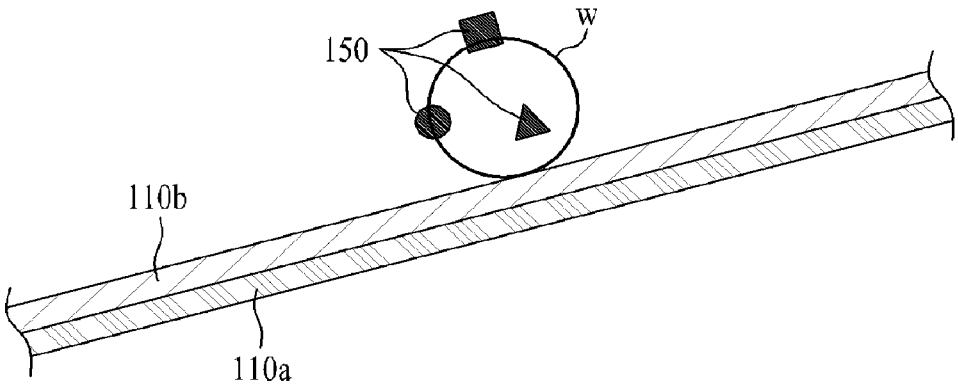
[Fig. 11]
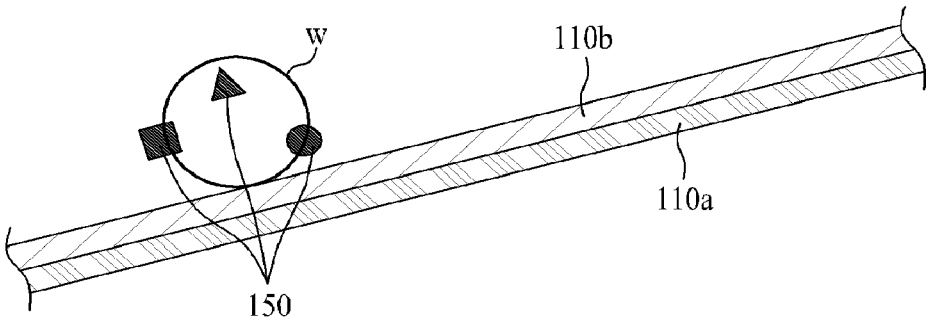

[Fig. 12]
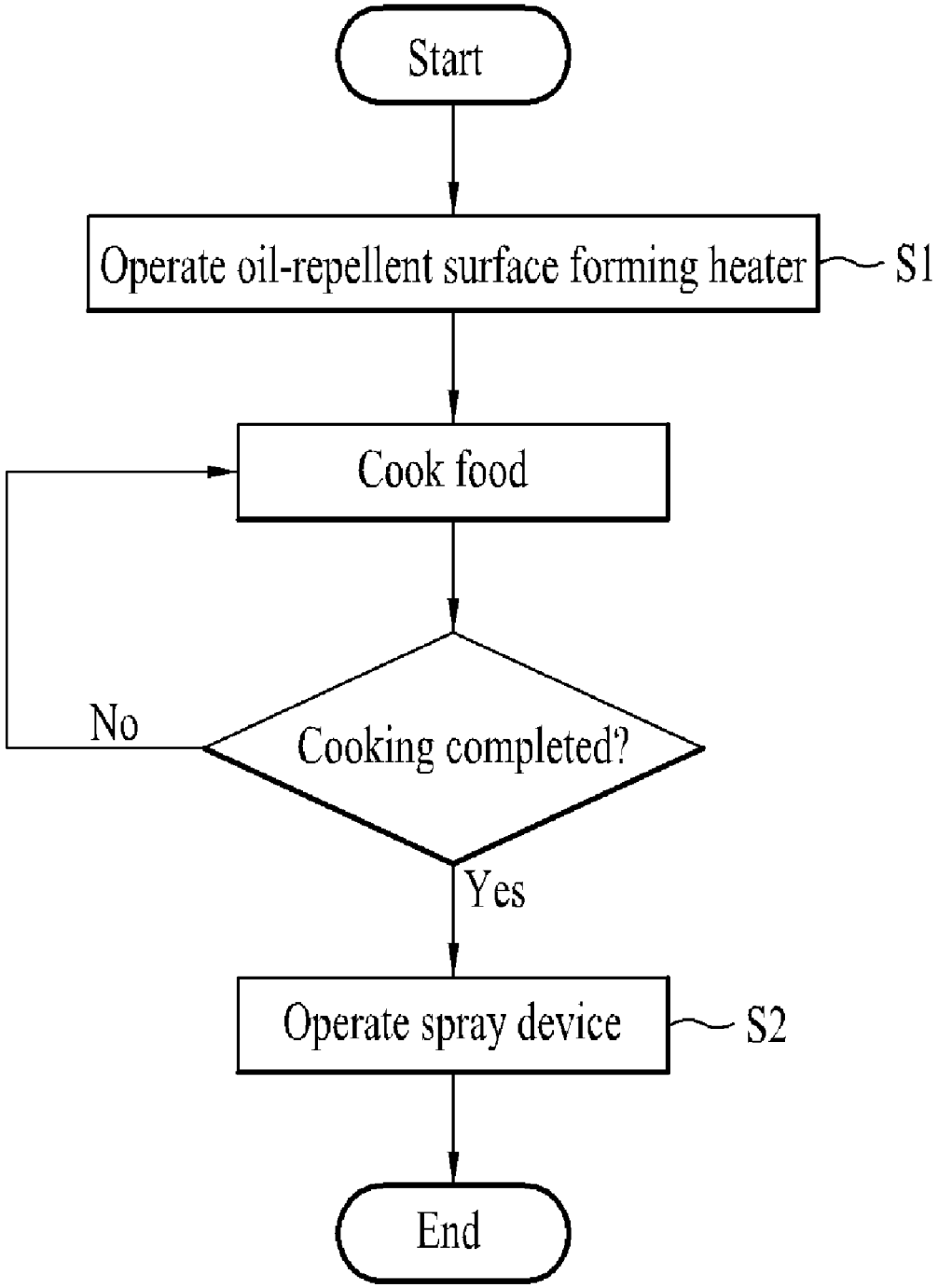

COOKING APPARATUS AND CLEANING METHOD FOR THE SAME

TECHNICAL FIELD

The present invention relates to a cooking apparatus, and more particularly, to a cooking apparatus for easier cleaning of contaminants (e.g., food residues) attached to the surface of a cavity in the cooking apparatus.

BACKGROUND ART

A cooking apparatus is generally used to cook food by heating the food. Representative examples of the cooking apparatus include a gas range, microwave oven, gas or electric oven.

Generally, an oven includes a cavity serving as a cooking space and a heater to heat the interior of the cavity.

In use of the oven, a tray or a sheet is filled/laid with an object or food (e.g., meatloaf, pork chops, or pizza) to be cooked, and place the tray/sheet into the cavity to heat the food by use of a heater.

In the course of heating the food received in the tray, the food may boil over or splash on the inner wall surface of the cooking apparatus. The resulting food residues attached to the wall/surface of the cooking apparatus shows a stronger adhesive power relative to the wall surface since the interior of the cavity is heated. Therefore, it is difficult to clean the food residues on the wall surface of the cooking apparatus. This problem commonly appears in a microwave oven as well as a gas or electric oven.

Recently, to facilitate the cleaning of the food residues attached to the wall surface of the cooking apparatus, it has been proposed to heat the interior of the cavity using high temperature after completing a cooking operation so as to burn the food residues. More specifically, in this solution to burn the food residue, the interior of the cavity is heated for 2 hours or more up to a temperature of about 460° C. or more.

DISCLOSURE OF INVENTION

Technical Problem

However, the above described conventional solution has disadvantages of excessive consumption of time and energy.

Further, due to the fact that the cooking apparatus emits high-temperature heat for a long time during a cleaning operation, there is a risk of thermal deformation of furniture installed around the cooking apparatus or generation of a fire.

To prevent the above described thermal deformation of furniture or fire, it is necessary to increase the amount of heat-insulating material used in the cooking apparatus. This results in a difficulty in the manufacture and design of the cooking apparatus and increases the overall manufacturing costs. Furthermore, the inner volume of the cavity must be reduced as much as the thickness of the heat-insulating material.

Technical Solution

In accordance with an aspect of the present invention, the object of the present invention can be achieved by providing a cooking apparatus comprising a body defining the outer appearance of the cooking apparatus, and a cavity defining a space for heating and cooking an object and forming an oil-repellent surface by heating an inner surface.

The inner surface of the cavity may form a super-water-repellent surface, and form the oil-repellent surface with heat application.

The cooking apparatus may further comprise a main heater provided in the body, to heat the interior of the cavity, and the inner surface of the cavity may be heated by heat generated from the main heater to form the oil-repellent surface.

The cooking apparatus may further comprise a spray device to inject water or steam onto the inner surface of the cavity.

The cavity may comprise a basic material, and an enamel layer constituting the inner surface of the cavity, the enamel layer being subjected to a plasma treatment to have a super-water-repellency.

In accordance with another aspect of the present invention, the object of the present invention can be achieved by providing a cooking apparatus comprising: a body defining the outer appearance of the cooking apparatus; a cavity defining a space for heating and cooking an object and forming an oil-repellent surface by heating an inner surface; a main heater to heat the interior of the cavity for cooking food; and an oil-repellent surface forming heater to heat the inner surface of the cavity.

The inner surface of the cavity normally may form a super-water-repellent surface and form the oil-repellent surface with heat application.

The oil-repellent surface forming heater may be operated in the initial operation of the cooking apparatus.

Preferably, the oil-repellent surface forming heater heats the inner surface of the cavity up to a temperature of 250° C. to 350° C. or more.

The cooking apparatus may further comprise a spray device to inject water or steam onto the inner surface of the cavity.

The spray device may comprise a water tank to store water therein, and a nozzle to inject water or steam onto the inner surface of the cavity.

The spray device may further comprise a steam heater to generate steam by heating the water stored in the tank.

Preferably, the spray device may be operated just after completing the cooking of food.

The cavity may comprise a basic material, and an enamel layer constituting the inner surface of the cavity, the enamel layer being subjected to a plasma treatment to have a super-water-repellency.

In accordance with yet another aspect of the present invention, the object of the present invention can be achieved by providing a cleaning method for a cooking apparatus comprising providing the inner surface of a cavity with an oil-repellency.

In the provision of the oil-repellency on the inner surface of the cavity, the inner surface of the cavity may be heated up to at least a predetermined temperature.

Preferably, the predetermined temperature is in a range of 250° C. to 350° C.

The provision of the oil-repellency on the inner surface of the cavity may be performed prior to cooking food.

The cleaning method may further comprise operating a spray device to wash contaminants attached to the inner surface of the cavity with water or steam.

Preferably, the operation of the spray device is performed after the cooking of food.

Advantageous Effects

A cooking apparatus and a cleaning method for the same according to the present invention have the following effects.

First, since the inner surface of a cavity in the cooking apparatus can acquire an oil-repellency prior to cooking food, it is possible to substantially prevent contaminants such as food residues, oil, etc. from being attached to the inner surface of the cavity. Also, even if the contaminants are attached to the inner surface, the contaminants have only a low adhesive power and are easy to clean.

Second, according to the present invention, by spraying water or steam onto the oil-repellent inner surface of the cavity, the contaminants attached to the inner surface can be washed together with the water running down on the inner surface. Since the water is collected on the bottom of the cavity and can be removed as a user wipes the water with a dishcloth or the like, it is possible to enhance simplicity in cleaning.

Third, the present invention can low the heating temperature of the cavity required for a cleaning operation as compared to the prior art. This has the effects of saving the consumption of energy and lowering the probability of the thermal deformation of the surrounding furniture and the risk of a fire, resulting in an improvement in the safety of a user.

Fourth, the present invention can eliminate a need for a thick heat-insulating material, thereby simplifying the design and manufacture of the cooking apparatus. As a result, the overall manufacturing costs of the cooking apparatus can be reduced. Also, the use of a thinner heat-insulating material has the effect of expanding the inner volume of the cavity.

Fifth, the present invention provides the inner surface of the cavity with a super-water-repellency via a plasma treatment performed on an enamel layer coated on a basic material of the inner surface. This allows the inner surface to have the super-water-repellency while maintaining mechanical properties of enamel. Therefore, as compared to other coating methods, such as a Teflon coating, the inner surface of the cavity can maintain the water-repellency even after a specified time period or after being cleaned numerous times, thereby showing a superior durability.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a perspective view illustrating the outer appearance of a cooking apparatus according to a preferred embodiment of the present invention.

FIG. 2 is a sectional view schematically illustrating the interior of the cooking apparatus of FIG. 1.

FIGS. 3 to 5 are views illustrating a difference in water-repellency according to a contact angle of a water droplet on a surface, FIG. 3 illustrating a super-hydrophilic surface, FIG. 4 illustrating a water-repellent surface, and FIG. 5 illustrating a super-water-repellent surface.

FIG. 6 is a configuration view schematically illustrating the plasma treatment of a basic material constituting the wall surface of a cavity.

FIG. 7 is a graph illustrating a relationship between the temperature of a water-repellent surface and a contact angle of oil on the surface.

FIG. 8 is a sectional view illustrating the wall surface of a cavity in the cooking apparatus of FIG. 1.

FIGS. 9 to 11 are views illustrating a water droplet with contaminants, which is running down on a super-water-repellent surface.

FIG. 12 is a flow chart illustrating the sequence of a cleaning method for the cooking apparatus according to a preferred embodiment of the present invention.

BEST MODE FOR CARRYING OUT THE INVENTION

Reference will now be made in detail to a cooking apparatus according to a preferred embodiment of the present invention, examples of which are illustrated in the accompanying drawings.

It is noted that the preferred embodiment of the present invention is also applicable to a microwave oven, etc. although the following description deals with a gas or electric oven.

FIG. 1 is a perspective view illustrating the outer appearance of a cooking apparatus according to the preferred embodiment of the present invention. FIG. 2 is a view schematically illustrating the interior of the cooking apparatus.

The cooking apparatus according to the present embodiment comprises a body 100 defining the outer appearance of the cooking apparatus, a cavity 110 provided in the body 100 to define a space for heating and cooking an object, and a heater to heat the inner space of the cavity 110 during a cooking operation.

The body 100 is provided, at a front surface thereof, with a control unit 104 to control the cooking apparatus. A door 102 is hingedly coupled to the front surface of the body 100, to open or close the cavity 110. Of course, it will be appreciated that the control unit 104 may have a remote-control function, and the door 102 may be installed slidably to the front surface of the body 100.

A rack 106, on which food can be arranged, is installed in the cavity 110. The rack 106 is adjustable in position within the cavity 110 according to the user's intention.

The rack 106 is provided at both ends thereof with rack supporters 108 to support the rack 106. Each of the rack supporters 108 includes a plurality of rack guides **108*b* capable of supporting the rack 106 and guide supporting members 108*a* to support the rack guides 108*b***.

The heater generally includes a top-surface heater 122 and a bottom-surface heater 124. If necessary, a convection heater 126, including a fan for a convective heating may be additionally installed at a rear surface. Here, it is noted that the position of the heater is not limited to the above description. For example, in the case of a microwave oven, a high-frequency oscillator (not shown) for emitting microwaves may be installed instead of the heater.

Preferably, the inner surface of the cavity 110 is treated to have super-water-repellency.

FIGS. 3 to 5 are views illustrating a relationship between a water-repellency of a surface and a contact angle of a water droplet on the surface.

First, a super-water-repellency will be described in brief. When a water droplet W is on a material surface S, the water droplet W has an angle with the material surface S. The angle is referred to as a contact angle $\alpha$.

As the contact angle increases, the surface energy of the material surface decrease, and consequently, the material surface has a greater water-repellency of repelling water. In general, if the contact angle $\alpha$ of the water droplet W on the material surface S is less than 10 degrees as shown in FIG. 3, it can be said that the material surface S has a super-hydrophilicity.

If the contact angle $\alpha$ is greater than 90 degrees as shown in FIG. 4, the material surface S has a water-repellency. In particular, if the contact angle $\alpha$ is greater than 140 degrees as shown in FIG. 5, the material surface S has a super-water-repellency. The super-water-repellent material surface S has an extremely low surface energy, and thus, the water droplet W on the material surface S keeps a shape similar to a sphere and does not become attached to the material surface S. Such a tendency is similarly applicable to other materials containing an oil component as well as water. In brief, as the surface energy of the material surface decreases, the material surface makes it difficult for an object to be attached thereto.

A method to provide the inner surface of the cavity 110 with a super-water-repellency may be selected from various methods such as a silicon oil coating and Teflon coating. In the present embodiment, a method for providing a super-water-repellency via a plasma treatment will be described.

Preferably, to provide the inner surface of the cavity 110 with a super-water-repellency, as shown in FIG. 6, enamel 110*b* can be coated over the surface of a basic material 110*a* of the cavity 110, and the surface of the enamel 110*b* can be subjected to a plasma treatment so that the surface of the enamel 100*b* can be equipped with a super-water-repellency.

The plasma treatment will be described in brief. Referring to FIG. 6, if a high voltage is applied to a pair of poles spaced apart from each other by a predetermined distance, an electric discharge occurs in a space between both the poles, thereby producing plasma. As the plasma comes into contact with a material surface, the material surface can be subjected to various treatments, achieving various effects such as washing, reforming, surface deformation, and de-oxidation of metal oxides.

For this reason, the surface of the basic material 110*a*, such as an iron plate constituting the cavity 110, is coated with the enamel 110*b*, and the surface of the enamel 110*b* is subjected to a plasma treatment so that the surface of the enamel 110*b* can have super-water-repellency.

In this case, if the plasma treatment is performed under the atmosphere of fluorinated gas, an enhanced super-water-repellency can be acquired.

The super-water-repellency or super-hydro-philicity degree of the enamel surface is adjustable by factors such as plasma treatment conditions, the strength of a voltage, treatment time, the types of surrounding gas, and a distance between the poles. This is well known in those skilled in the art, and thus, a detailed description thereof will be omitted.

When performing the plasma treatment on the surface of the enamel 110*b*, the surface of the enamel 110*b* can acquire an enhanced super-water-repellency while maintaining mechanical properties of enamel. As compared to the case where another component is coated on the surface of the enamel 110*b*, the plasma treatment is effective in maintaining the super-water-repellency of the enamel surface even after a specified time has passed or after performing numerous cleaning operations. Further, the enamel surface maintains a high hardness of enamel, showing a superior wear-resistance and durability.

It is noted that a method for providing the inner wall surface of the cavity with a super-water-repellency according to the present invention is not limited to the above described plasma treatment, and other methods may be used to provide a super-water-repellency.

Meanwhile, most contaminants, such as food residue, which can attach (or stick) to the inner surface of the cavity 110 contain an oil component, and thus, tend to have a small contact angle on the super-water-repellent surface of the cavity 110. However, if the super-water-repellent surface is heated, the super-water-repellent surface also has a great contact angle with respect to the oil component.

Accordingly, as shown in FIG. 2, to assure that the inner wall surface of the cavity 110 to have a great contact angle of 90 degrees or more with respect to the oil component as well as water, an oil-repellent surface forming heater 128 for heating the super-water-repellent inner wall surface of the cavity 110 may be provided separately from the heaters 122, 124, and 126 which are used to heat the cavity 110 during a cooking operation.

Preferably, the oil-repellent surface forming heater 128, as shown in FIG. 8, is embedded inside the wall surface of the cavity 110 to directly heat the wall surface, i.e. the water-repellent surface of the cavity 110.

The present invention is not limited to the provision of the oil-repellent surface forming heater 128, and the inner surface of the cavity 110 may be heated only by the heaters 122, 124, and 126, which are used to heat the cavity 110 during a cooking operation, without the oil-repellent surface forming heater.

FIG. 7 is a graph illustrating a relationship between the temperature of a water-repellent surface and a contact angle of oil on the water-repellent surface.

It can be appreciated from FIG. 7 that, if the temperature of the super-water-repellent surface reaches a temperature of 250° C. to 350° C., a contact angle of oil on the super-water-repellent surface can be 90 degrees or more. Hereinafter, it is referred that, if the contact angle of oil on a super-water-repellent surface is 90 degrees or more, the super-water-repellent surface also has an oil-repellency.

Even if the contact angle of oil on the surface is less than 90 degrees (or not exactly 90 degrees) and/or has a value close to 90 degrees, the surface can be referred to as an oil-repellent surface.

Accordingly, the oil-repellent surface forming heater 128 preferably heats the inner surface of the cavity 110 up to a temperature of 250° C. to 350° C. or more.

Although it is considerable to provide the super-water-repellent inner surface of the cavity 110 with an oil-repellency as the super-water-repellent inner surface is heated by the heaters 122, 124, and 126 during a cooking operation, the heaters 122, 124, and 126 are installed only at the inner top and bottom of the cavity 110, and therefore, both inner side surfaces of the cavity 110 having no heater 122, 124, or 126 are heated late, and may fail to have an oil-repellency upon an initial operation of the heaters 122, 124, and 126.

By installing the oil-repellent surface forming heater 128 in the cooking apparatus prior to beginning a operation of the cooking apparatus and by operating the oil-repellent surface forming heater 128 at the initial cooking operation to heat the super-water-repellent inner surface of the cavity 110, oil-repellency can be formed in the inner surface of the cavity 100 from the beginning of the initial cooking operation. As a result, the contaminants (e.g., food residue) cannot easily stick to attach to the inner surface of the cavity 110. Furthermore, even if the contaminants are attached to the inner surface of the cavity 110, the contaminants have only a very low adhesive power. That is, the contaminants can be more easily removed than non-treated inner surface.

Here, even if oil-repellency is formed with heat applied to the super-water-repellent surface, the super-water-repellent surface does not lose water-repellency even after it acquires an oil-repellency by being heated. That is, the heated super-water-repellent surface has the qualities of both the water-repellency and the oil-repellency.

The oil-repellent surface forming heater 128 is installed only at positions of the inner surface of the cavity having no heater 122, 124, or 126, such that the oil-repellent surface forming heater 128 operates, together with the heaters 122, 124, and 126, to heat the inner surface of the cavity 110 for providing the inner surface with an oil-repellency. Alternatively, the oil-repellent surface forming heater 128 may be installed throughout the inner surface of the cavity 110.

Meanwhile, instead of providing the oil-repellent surface forming heater 128, only the heaters 122, 124, and 126, which are operated during a cooking operation, may be used to heat the super-water-repellent inner surface of the cavity 110 for providing the super-water-repellent inner surface with oil-repellency.

In the present embodiment, as shown in FIG. 2, to facilitate the cleaning of the interior of the cavity 110, a spray device 130 may be provided to inject water or steam into the cavity 110.

Preferably, the spray device 130 includes a water tank 132 disposed in the body 100 to store water therein, and a nozzle 134 to inject the water stored in the water tank 132 into the cavity 110 or to inject steam, which is produced as the water in the water tank 132 is heated, into the cavity 110.

If necessary, a pump 136 may be provided to transfer the water from the water tank 132 to the nozzle 134.

FIGS. 9 to 11 are views illustrating a water droplet and contaminants on a super-water-repellent or oil-repellent surface.

As an object to be cooked is heated during a cooking operation, contaminants 150, such as food residue or oil, can be splashed on the wall surface 110*a* and 110*b* of the cavity 110.

In this case, since the wall surface 110*a* and 110*b* of the cavity 110 has a super-water-repellency and oil-repellency, the wall surface has a very low surface energy and makes it difficult for the contaminants to be attached or stick thereto. Even if the contaminants are adhered to the wall surface 110*a* and 110*b*, the contaminants have only a very low adhesive power.

Then, if water droplets W are sprayed onto the surface 110 and 110*b*, the water droplets W run down on the surface 110 and 110*b* by gravity, rather than being adhered to the surface 110 and 110*b*. As the water droplets W run down, they can wash the contaminants 150 attached/stuck to the surface 110 and 110*b*. As described above, the contaminants 150 adhered to the surface 110*a* and 110*b* have a very low adhesive power due to a low surface energy of the surface 110 and 110*b*, and thus, are easy to be washed by the running water droplets W.

More specifically, with the provision of the nozzle 134 to inject water or steam onto the inner surface of the cavity 110, the contaminants 150, such as food residues and oil, attached to the inner surface of the cavity 110 can be easily washed by the water droplets W that were injected from the nozzle 134 and are running down on the inner surface of the cavity 110.

Preferably, the amount of steam or water is determined such that water droplets are formed uniformly and run down throughout the inner surface of the cavity 110. To form the water droplets W throughout the inner surface of the cavity 110, it is possible to provide a plurality of nozzles 134.

If it is desired to inject steam, a steam heater (not shown) may be further provided to heat water flowing between the water tank 132 and the nozzle 134 or to heat water received in the water tank 132. Here, the water may be heated by the heaters 122, 124, 126, and 128 used to heat the cavity 110.

The injection of water or steam may be set such that the cooking device automatically injects water or steam to begin the cleaning of the cavity 110 after the cooked object or food (e.g., meatloaf, lasagna, or pork chops) is pulled out of the cavity 110. Here, a time to begin a cleaning operation using steam or water may be set to a point in time when the door 102 of the cooking apparatus is initially opened and closed after completing a cooking operation, or may be set in other various manners. Furthermore, the control unit 104 has a button or the like to manually input a signal into the body such that a cleaning operation using steam or water can be commenced by, for example, a user's external input operation.

Hereinafter, a preferred embodiment of a cleaning method for the cooking apparatus of the present invention will be described. FIG. 12 is a flow chart illustrating the sequence of the cleaning method for the cooking apparatus according to the preferred embodiment of the present invention.

First, an operation for providing the super-water-repellent inner surface of the cavity 110 with an oil-repellency is performed.

In the operation to provide the oil-repellency, the inner wall surface of the cavity 110 is preheated prior to beginning a cooking operation, to provide the super-water-repellent inner wall surface of the cavity 110 with the oil-repellency.

The inner wall surface of the cavity 110 may be heated by operating at least one of the heaters 122, 124, and 126 used for a cooking operation. If the oil-repellent surface forming heater 128 is provided, the oil-repellent surface forming heater 128 is operated to heat the inner wall surface of the cavity 110.

When using the oil-repellent surface forming heater 128 separately provided from the heaters 122, 124, and 126 used to heat the interior of the cavity 110, the interior of the cavity 110 is preheated by the heat generated by the oil-repellent surface forming heater 128. This has the effect of reducing the overall cooking time. In addition, since the oil-repellent surface forming heater 128 directly heats the wall surface of the cavity 110, rather than indirectly heating the wall surface of the cavity 110 by heating the interior of the cavity 110, a time required to provide an oil-repellency can be reduced.

Preferably, the oil-repellent surface forming heater 128 heats the super-water-repellent inner wall surface of the cavity 110 up to a temperature of 250° C. to 350° C. or more as described above.

Once the inner wall surface of the cavity 110 has the oil-repellency, an operation for cooking food by heating the food is performed.

During the cooking operation of the food, contaminants 150, such as oil and food residues, are splattered and/or adhered on the inner wall surface of the cavity 110.

In this case, since the inner wall surface of the cavity 110 has the oil-repellency, the contaminants 150 have difficulty being attached to the inner wall surface of the cavity 110. Even if the contaminants 150 are attached to the wall surface of the cavity 110, the contaminants 150 have only a very low adhesive power.

After the cooked food is pulled out of the cavity 110, the spray device 130 is operated to inject steam or water onto the inner wall surface of the cavity 110.

Preferably, an operation for operating the spray device 130 is performed after the cooked object is pulled out of the cavity 110. This is because injecting steam or water into the cavity 100, which still receives the cooked food therein, has a risk of affecting the food (e.g., taste).

If the spray device 130 is operated, as shown in FIGS. 9 to 11, water droplets W are formed on the inner wall surface of the cavity 110 by steam or water. As the water droplets W grow in size, the water droplets W run down on the inner wall surface of the cavity 110 due to gravity. In this case, since the inner surface of the cavity 110 has the oil-repellency, the contaminants 150 (e.g., oil and food residues) attached to the wall surface are washed by the water droplets W running down on the wall surface(s). The water droplets W are finally collected on the bottom of the cavity 110.

If a user wipes the water and contaminants collected on the bottom of the cavity 110 by use of a dishcloth or the like after completing the operation of the spray device 130, the cleaning of the cavity 110 is completed.

As apparent from the above description, according to the present invention, the oil-repellent surface can be acquired as the surface is heated only up to a temperature about 250° C. to 350° C. This temperature range is a decrease of 100° C. to 200° C. compared with a temperature of 450° C. required in a conventional heating and burning method, and also, a heating time is reduced. Accordingly, the oil-repellent surface can be acquired with a low consumption of energy.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A cooking apparatus comprising:

a body defining the outer appearance of the cooking apparatus;

a cavity defining a space for heating and cooking an object, an inner surface of the cavity forming an oil-repellent surface when heated;

a main heater to heat the interior of the cavity for cooking food;

an oil-repellent surface forming heater to heat the inner surface of the cavity; and a spray device to inject water or steam onto the inner surface of the cavity, so as to wash contaminants attached to the inner surface of the cavity, wherein the cavity includes:

a basic material; and an enamel layer constituting the inner surface of the cavity.

2. The cooking apparatus according to claim 1, wherein the inner surface of the cavity normally forms a super-water-repellent surface, and forms the oil-repellent surface when heated.

3. The cooking apparatus according to claim 1, wherein the oil-repellent surface forming heater is operated in the initial operation of the cooking apparatus.

4. The cooking apparatus according to claim 1, wherein the oil-repellent surface forming heater heats the inner surface of the cavity up to a temperature of 250° C. to 350° C. or more.

5. The cooking apparatus according to claim 1, wherein the spray device comprises:

a water tank to store water therein; and a nozzle to inject water or steam onto the inner surface of the cavity.

6. The cooking apparatus according to claim 5, wherein the spray device further comprises a steam heater to generate steam by heating the water stored in the tank.

7. The cooking apparatus according to claim 1, wherein the spray device is operated after completing the cooking of food.

8. The cooking apparatus according to claim 1, wherein the enamel layer is subjected to a plasma treatment to have a super-water-repellency.

* * * * *